United States Patent [19]

Burwell

[11] Patent Number: 4,687,134

[45] Date of Patent: Aug. 18, 1987

[54] RAILWAY FASTENING

[75] Inventor: Gar W. N. Burwell, Madison, N.J.

[73] Assignee: Rails Company, Maplewood, N.J.

[21] Appl. No.: 845,486

[22] Filed: Mar. 28, 1986

Related U.S. Application Data

[63] Continuation of Ser. No. 314,557, Oct. 26, 1981, abandoned.

[51] Int. Cl.[4] ..... E01D 19/12; E01B 9/30

[52] U.S. Cl. ..... 238/349; 238/26; 238/310

[58] Field of Search ..... 238/1, 26, 310, 338, 238/349; 14/73, 74

[56] References Cited

U.S. PATENT DOCUMENTS

| | | | |
|---|---|---|---|
| 793,449 | 6/1905 | Le Fevre | 238/338 X |
| 1,922,814 | 8/1933 | MacLean | 238/349 X |
| 2,203,994 | 6/1940 | Magee | 238/349 |
| 3,362,639 | 1/1968 | Van Sant | 238/349 |
| 3,515,347 | 6/1970 | Waters et al. | 238/349 X |
| 3,552,649 | 1/1971 | Burwell | 238/349 |
| 3,659,784 | 5/1972 | Klosk | 238/349 |
| 3,796,369 | 3/1974 | Favil | 238/349 |
| 4,254,909 | 3/1981 | Rex | 238/349 X |

*Primary Examiner*—Randolph A. Reese
*Attorney, Agent, or Firm*—Edward R. Weingram

[57] ABSTRACT

A railway fastening, especially adapted for securing a bridge girder or cover plate of the girder to a cross-tie on a bridge, or like supporting structure, is in the form of a resilient clip having a substantially planar body portion with an opening for a bolt which is offset with respect to the resilient end engaging bridge girder. The resilient end in the form of a compression arch engages a girder flange to limit vertical movement and a tie-engaging end includes downwardly and outwardly extending ears for laterally restraining the cross-tie. A shoulder on the resilient end also engages a side of the girder flange to further limit lateral movement. In order to provide greater resilience, the arch can be in the form of two separate finger portions joined at the base with the body portion to form a U, each of the finger portions having a lip adapted to overlie the girder flange. A projecting lug adjacent to the opening for the bolt is provided to facilitate securing a bolt tensioning member, i.e., a nut. The clip thus serves as a large washer to firmly hold the cross-tie as well as the girder when the bolt is inserted through the opening and secured with the nut.

12 Claims, 8 Drawing Figures

26
28
30
35
36
38
14
12
24
32
40

RAILWAY FASTENING

This is a continuation of co-pending application Ser. No. 314,557 filed on Oct. 26, 1981, now abadoned.

BACKGROUND OF THE INVENTION

1. Field of the Invention

This invention relates to a railway fastening for use in combination with a railway bridge girder and a cross-tie, and in particular to a railway fastening in the form of a resilient clip for securely fastening a girder to a cross-tie on a bridge or other supporting structure.

2. Description of the Prior Art

Various railway fastenings are described and shown in the prior art but there is a need for a simple reliable railway fastening for securing a girder to a cross-tie on a bridge or other supporting structure.

U.S. Pat. No. 3,552,649 to Burwell shows a railway fastening for resiliently securing a cross-tie on a bridge in the form of an elongated resilient clip of rectangular crosssection. The clip has a flat end bearing portion for engaging the lower face of a tie and an arcuate bearing portion at its opposite end to bear against a bridge girder or cover plate for securing the tie to the girder. The arcuate portion of the clip has an elongated slot extending longitudinally on the clip to receive a bolt having a diameter substantially less than the length of the slot and such as to slidably engage the side's of the slot. This slidable engagement enables the angular position of the clip to be adjusted relative to the bolt to thereby adjust the position of the arcuate bearing portion so that the clip can be used with cover plates or girder flanges of substantially different thicknesses.

While this clip has performed satisfactorily in most situations,problems arise if the size of the steel tie plate that is on top of a wooden tie is increased, so that the steel tie plate is actually wider than the flange of the steel girder underneath the tie. The top tie plate then interferes with drilling a bolt hole to permit the tie to be fastened to the girder flange. It now becomes necessary to move the bolt hole to the side of the girder flange. Consequently, if the bolt is placed outside of the tie plate it will not be next to the girder after passing through the tie and the tie will not be securely fastened. In addition, when the bolt passes through the arcuate portion, care must be taken to avoid excessive tightening of the bolt which can limit the desired resiliency of the clip in securing the girder.

U.S. Pat. No. 3,659,784 shows a bracket for use with a clamp and screw spike adapted to clamp elevated railroad ties to a support structure. The bracket comprises a U-shaped member with a base portion and vertically extending wing portions. The base portion is provided with a washer held in an elongated slot. The washer registers with the nut shaped portion of the screw spike to enable the vertically extending wing portions of the bracket to be positioned for securing to the tie. The bracket prevents the screw spike and clamp from disengaging and falling from the tie.

Other rail fastening devices are shown in U.S. Pat. No. 3,796,369 in which one portion of the fastener overlies the rail flange and the other portion contacts a supporting surface and is secured thereto to resist rotational movement. U.S. Pat. No. 3,362,639 shows another rail fastening that is in the form of a spring clip having a compression arch, a rail flange gaging end, and an intermediate rib provided with a depending rail side edge engaging portion. Tightening of a pressure block disposed above the clip flexes the arch and rib to embrace the rail and inhibit both longitudinal and lateral displacement of the rail.

Another rail fastening in the form of a clip for positioning a rail to a sleeper is shown in U.S. Pat. No. 4,254,909. The clip shown there is a spring plate, shaped so that when retained near its midpoint, one end bears against the upper surface of the rail while the other bears against a sleeper or bearing pad on the sleeper. The slit is urged downwardly against the foot of the rail by a loop extending upwardly from the sleeper and a locking pin passing through the loop and bearing against the intermediate locality of the clip.

SUMMARY OF THE INVENTION

The invention contemplates a resilient clip having a substantially planar body portion with an opening for a bolt which is offset with respect to a bridge girder or cover plate, a girder flange engaging end in the form of a resilient ccmpressions arch to restrain vertical movement, and a tie engaging end having downwardly and outwardly extending ears for laterally restraining the cross-tie. A shoulder on the resilient arch also engages the side of the girder flange to provide further lateral restraint. In effect, the clip resembles a relatively flat spring washer with an arched end which, when a bolt is inserted through the opening and a bolt-tensioning member, such as a nut, is secured to the bolt, presses against the girder flange, while the ears press against the cross-tie to restrain lateral and vertical movement thereof.

It is therefore an object of the invention to provide an improved railway fastening which is simple in construction and yet which can secure a bridge girder to a cross-tie and prevent the cross-tie from lateral and vertical movement on a bridge or similar structure.

It is a further object of the invention to provide a railway fastening suitable for use on a bridge supporting structure in which the fastening is secured to a girder and a flat portion engaging the tie to provide lateral as well as vertical restraint.

A still further object of the invention is to provide a resilient railway fastening device wherein the securing bolt is displaced from the resilient spring portion to permit securing the fastening device to the tie without limiting the resiliency of the spring portion or interfering with a girder cover plate.

Another object of the invention is to provide a railway fastening device having a resilient spring portion engaging the flange of a girder and including a shoulder engaging the side of the flange for further lateral restraint.

The objects and advantages of the invention will be more fully described in connection with an illustrative embodiment shown in the drawings.

DESCRIPTION OF THE PREFERRED EMBODIMENTS

Figure 1:
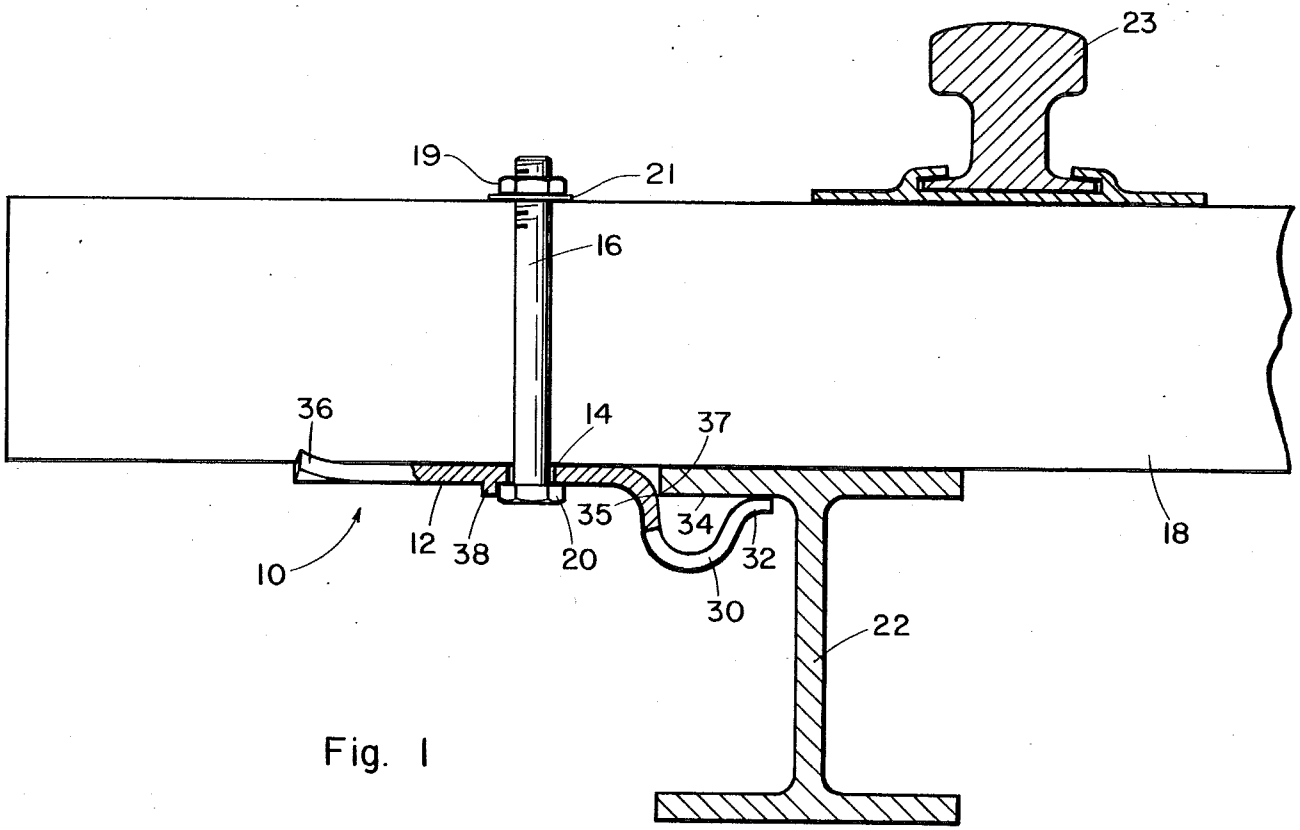
FIG. 1 is a side view in partial cross-section showing the railway fastening device securing a girder to a cross tie supporting a rail.
Figure 2:
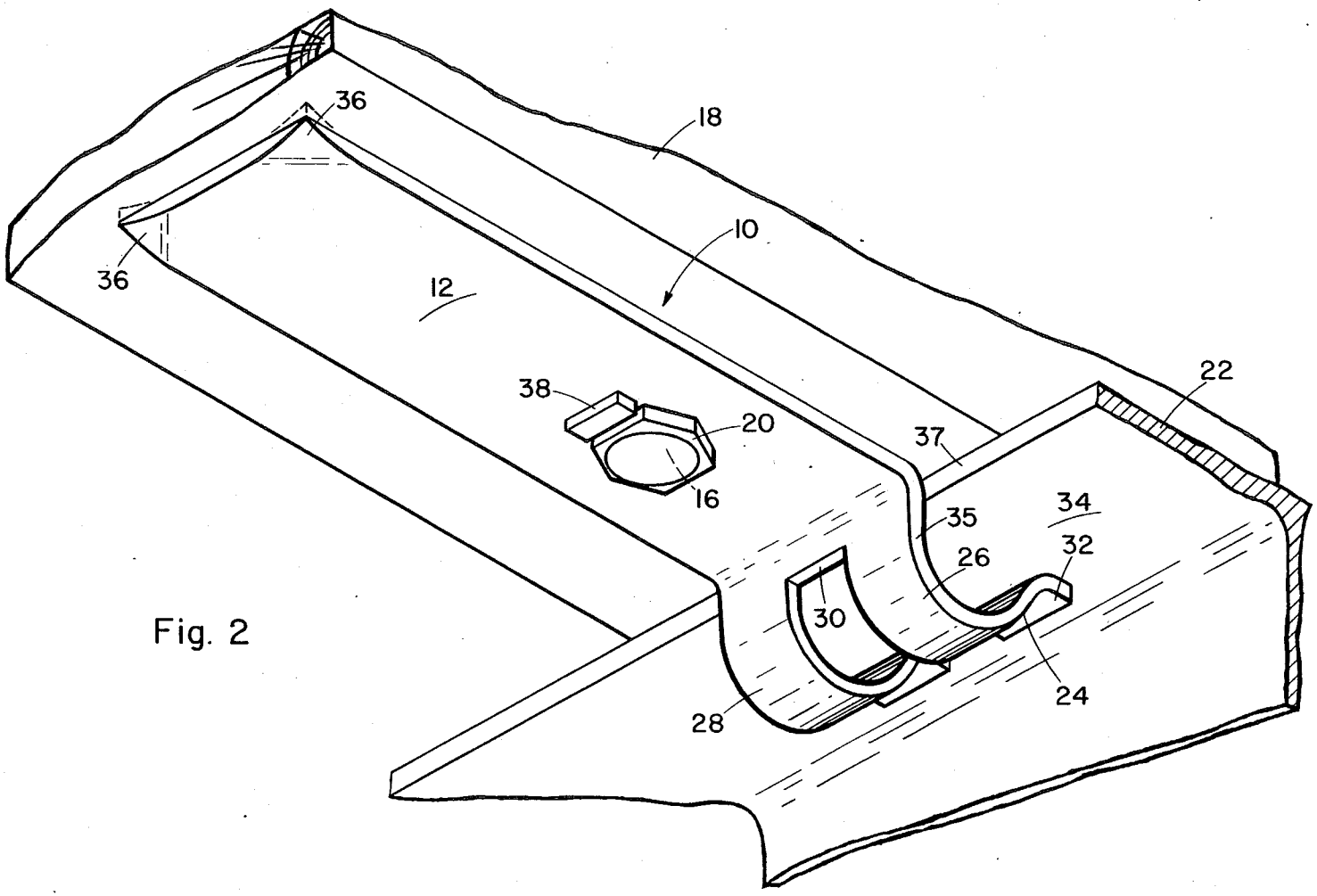
FIG. 2 is an enlarged perspective bottom view showing the railway fastening device securing a girder flange to a cross tie.

As shown in FIGS. 1 and 2, the railway fastening 10 is in the form of a substantially planar clip having a curved end. The main flat body portion 12 includes an opening 14 shown more clearly in FIGS. 3 and 5, for receiving a bolt 16 for securing the clip to a cross-tie 18. The hole is offset or spaced from the curved end. The head 20 of the bolt is prevented from turning by lug 38 and is secured by a bolt. The curved end engages a girder 22 which supports a rail 23 secured on the cross-tie 18.

Figures 3, 4, 5, 6, 7, 8:
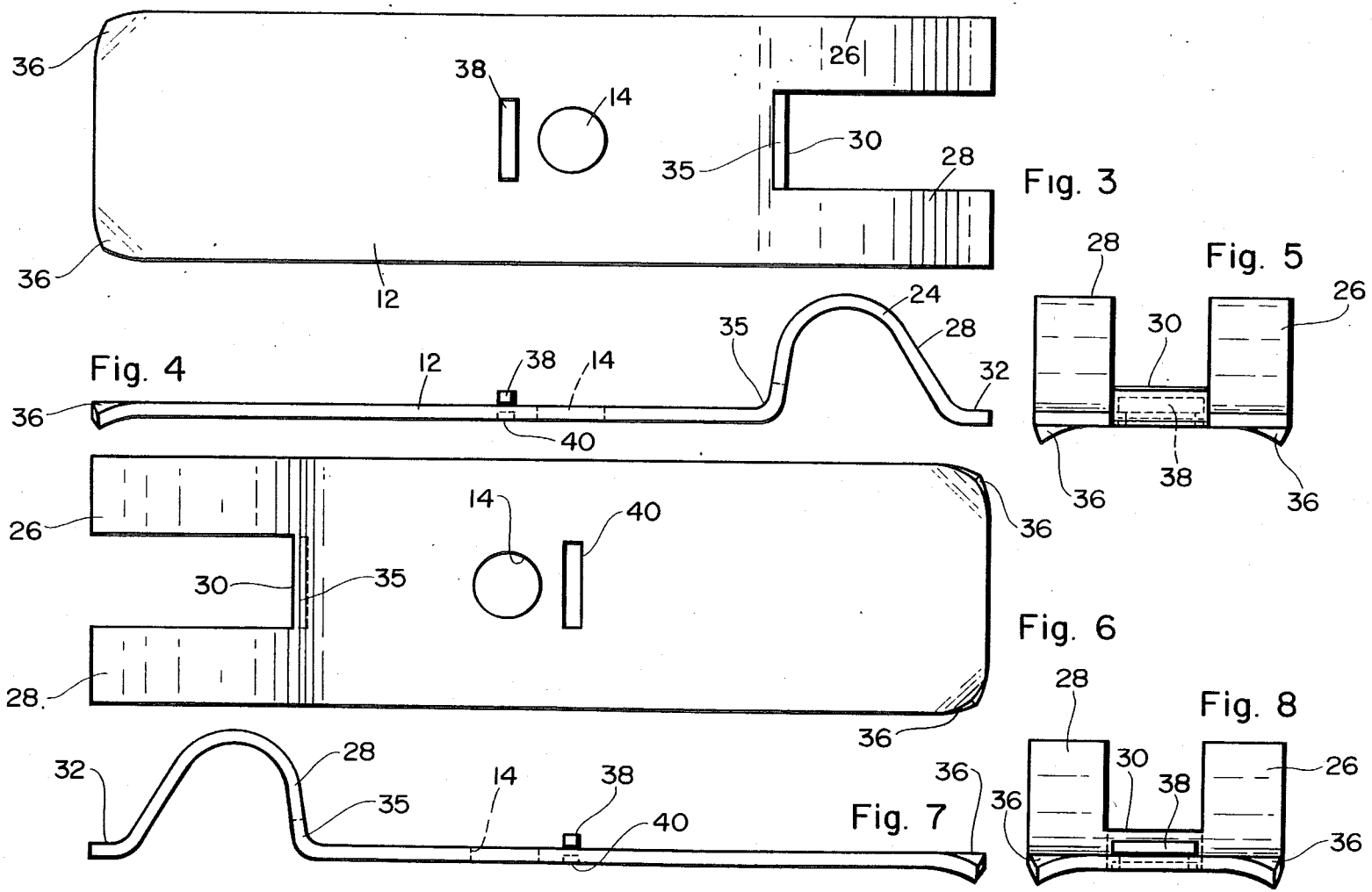
FIG. 3 is a top view of the railway fastening device.
FIG. 4 is a side view of the device.
FIG. 5 is an end view of the device.
FIG. 6 is a bottom view of the device.
FIG. 7 is an opposite side view of the device.
FIG. 8 is an opposite end view of the device.

The curved end of the clip holding the girder is in the form of a compression arch 24, which arch engages the beam to prevent lateral movement of the cross-tie, as shown in FIGS. 4 and 7, which, has two fingerlike portions 26 and 28, shown in FIGS. 3, 5, 6, and 8, joined at the base to the body portion 12 and forming a U-shaped notch 30. Each of the finger-like portions has a lip 32 which overlies the horizontal girder flange 34.

The clip, including the compression arch, is made of a relatively thin sheet of material, such as steel, which is resilient. The arch may be of one piece but preferably, as shown, is formed by two separated fingers to provide added resilience. Thus, when the bolt is tightened, the flat portion of the clip presses against the cross-tie, and the arch resiliently grips the girder flange. An inner shoulder 35 of the arch also engages the side edge 37 of the flange to provide lateral restraint.

At the other end of the body portion 12 are two downwardly and outwardly extending ears or tabs 36 which, when nut 20 or the bolt 16 is tightened, grip the cross-tie, restraining lateral and vertical movement thereof, as well as longitudinal movement.

A projecting lug 38 on the body portion adjacent to the bolt aperture 14 permits the nut 20 to be tightened on the bolt with a single wrench while preventing the bolt from turning, and thus, simplify fixing the clip in position. The underside may be indented at the lug as shown at 40.

The offset of the bolt opening 14 from the girder flange 34 and resilient fingers 26, 28 permits use of various sized girders and cover plates without interference from the bolt. In addition, the resilient spring action permits some vertical movement while firmly holding the girder in position against the ties without a fixed limit as in the case where the bolt passes through the resilient end. The bolt, shoulder of the curved resilient end, and ears at the opposite end all cooperate in limiting lateral movement of the girder and ties, and the bolt can be tightened fully directly on the washer-like flat portion of the fastening device against the ties to secure the elements together.

The use of two spring fingers separated by the notch provides a desired degree of resilience for maximum contact of the shoulder with the side of the flange. The curved lip at the ends of the spring fingers also applies the force more uniformly across the girder flange and avoids the stiffness of a sharper edge.

The present invention thus provides an improved simplified railway fastening device which is adaptable to various supporting structures. While the invention has been described in connection with a specific embodiment, it is apparent that many variations may be made in the particular design and configuration without departing from the scope of the invention as set forth in the appended claims.

What is claimed is:

1. A railway fastening for use in combination with a cross-tie and a supporting girder having a flange comprising:

(a) a resilient clip including a longitudinal substantially planar body portion having an opening to receive a bolt extending through the cross-tie, an end spaced from said opening and engageable with the flange of the supporting girder and another end engageable with the cross-tie;

(b) a compression arch in said end spaced from said opening for resiliently engaging said flange said arch includes a shoulder portion adapted to engage a side of said flange, to laterally restrain said cross-tie;

(c) a pair of ears in the tie-engaging end to laterally restrain the cross-tie; and (d) means to tension said bolt to resiliently secure said clip to said cross-tie and said flange.

2. A railway fastening as claimed in claim 1 wherein said arch has a lip portion adapted to overlie and engage said flange.

3. A railway fastening as claimed in claim 2 wherein said arch includes two separated finger-like portions joined at the base to form a U.

4. A railway fastening as claimed in claim 1 wherein said ears project outwardly and downwardly from said tie-engaging end.

5. A railway fastening as claimed in claim 1 wherein a projecting lug is located adjacent said opening to engage the bolt.

6. A railway fastening for use in a bridge tie anchor comprising:

(a) a resilient clip including a substantially planar body portion having an opening therein to receive a bolt extending through a cross-tie, a bridge girder flange engaging end, and a tie engaging end, said opening being spaced from said flange engaging end;

(b) a compression arch in said flange engaging end for resiliently engaging said flange, said arch includes a shoulder portion adapted to engage a side of said flange to laterally restrain said cross-tie;

(c) a pair of ears in said tie-engaging end to laterally restrain said cross-tie;

(d) a projecting lug adjacent said opening in the body portion to prevent movement of said bolt during tensioning therepf; and (e) means to tension said bolt to resiliently secure said clip to said tie end and said flange.

7. A railway fastening as claimed in claim 6 wherein said arch has a lip portion adapted to overlie and engage said flange.

8. A railway fastening as claimed in claim 7 wherein said arch includes two finger portions joined at the base with said body portion and a notch separating said finger portions.

9. A railway fastening as claimed in claim 6 wherein said ears extend downwardly and outwardly from the plane of said body portion.

10. The combination of a wooden tie resting on a girder, an elongated resilient clip having a flat bearing portion engaging the lower face of said tie, said flat bearing portion having projections at one end embedded in said tie and a bolt receiving hole through said flat portion and tie, said clip having an arcuate portion at the opposite end spaced from said hole for resiliently engaging a flange of said girder, a bolt passing through said hole in said flat portion and tie, and means for tensing said bolt to resiliently secure said clip to said tie and flange, said arcuate portion including a shoulder portion engaging a side of said flange to laterally restrain said tie.

11. The combination of claim 10 wherein said arcuate portion includes two finger portions joined at a base to said flat portion and having a notch separating said finger portions.

12. The combination of claim 10 including a lug extending adjacent said hole on said flat portion for engaging said bolt.

* * * * *